US005868552A

United States Patent [19]

McKean et al.

[11] Patent Number: 5,868,552

[45] Date of Patent: Feb. 9, 1999

[54] VARIABLE GEOMETRY TURBINE

[75] Inventors: Peter Stuart McKean; David Michael Moulson, both of Huddersfield, England

[73] Assignee: Holset Engineering Co., Ltd., Huddersfield, England

[21] Appl. No.: 95,337

[22] Filed: Jun. 10, 1998

[30] Foreign Application Priority Data

Jun. 10, 1997 [GB] United Kingdom ..... 9711897

[51] Int. Cl.[6] ..... F01B 25/02

[52] U.S. Cl. ..... 415/158; 415/157; 415/111; 415/112; 415/159; 415/175

[58] Field of Search ..... 415/111, 112, 415/157, 158, 150, 159, 165, 175

[56] References Cited

U.S. PATENT DOCUMENTS

| | | | |
|---|---|---|---|
| 4,571,154 | 2/1986 | Weber | 415/158 |
| 4,582,466 | 4/1986 | Szczupak | 415/150 |
| 5,044,880 | 9/1991 | McKean | 415/148 |
| 5,522,697 | 6/1996 | Parker et al. | 415/158 |

*Primary Examiner*—Thomas E. Denion
*Assistant Examiner*—Ninh H. Nguyen
*Attorney, Agent, or Firm*—Gary M. Gron

[57] ABSTRACT

A variable geometry turbine in which a turbine wheel is mounted to rotate about a pre-determined axis within a housing. A sidewall is displaceable relative to the housing to control the width of a gas flow passage defined adjacent the wheel between the first surface defined by the sidewall and the second surface defined by the housing. The sidewall is mounted in the sidewall cavity within the housing on axially displaceable rods extending parallel to the rotation axis of the wheel. A yoke is pivotally supported within the housing and defines arms each of which extends into engagement with a respective sidewall support rod. The yoke is pivoted relative to the housing to control the position of the sidewall relative to the housing. The yoke is located within a yoke chamber defined by the housing, and lubricant is delivered to the yoke chamber to lubricate both the bearing upon which the yoke is pivotally mounted in the housing and surfaces which interengage the yoke and the sidewall support rods. The yoke chamber is spaced from sealed against communication with the sidewall cavity.

4 Claims, 3 Drawing Sheets

VARIABLE GEOMETRY TURBINE

TECHNICAL FIELD

The present invention relates to a variable geometry turbine incorporating a displaceable sidewall.

BACKGROUND OF THE INVENTION

U.S. Pat. No. 4,973,223 describes a known variable geometry turbine in which a turbine wheel is mounted to rotate about a pre-determined axis within a housing. A sidewall is displaceable relative to a surface defined by the housing in order to control the width of gas flow passage defined adjacent the wheel between the sidewall and that surface. The sidewall is supported on rods extending parallel to the wheel rotation axis, and the rods are axially displaced relative to the housing so as to control the position adopted by the sidewall.

The rods are displaced by a pneumatic actuator mounted on the outside of the housing, the pneumatic actuator driving a piston which is displaceable parallel to the turbine axis. The actuator piston is coupled to the sidewall by a yoke pivotally supported on a bracket mounted on the housing, the yoke defining two spaced apart arms which extend on opposite sides of the turbine axis to engage portions of the support rods extending outside the housing. The end of each arm is received in a slot in a respective sidewall support rod. Displacement of the actuator piston causes the yoke to pivot and to drive the sidewall in the axial direction as a result of the interengagement between the yoke arms and the sidewall support rods.

In the known variable geometry turbine, the yoke pivot is located in the hostile environment outside the housing and cannot be readily lubricated. The engagement of the yoke arms with the rods is of a sliding nature and, although it is known to incorporate wear resistant relatively sliding surfaces made from for example ceramics, those surfaces cannot readily be lubricated. Accordingly wear can be a problem with the known assembly.

U.S. Pat. No. 5,522,697 describes an alternative yoke assembly to that described in U.S. Pat. No. 4,973,223. In that alternative assembly, the sidewall support rods are engaged by a yoke pivotally mounted within the housing on a shaft that extends outside the housing. An external actuator controls the rotation of the shaft and thus displacement of the yoke which engages in slots in the sidewall support rods. The yoke is mounted in a cavity immediately behind the sidewall.

With the arrangement of U.S. Pat. No. 5,522,697, the yoke is relatively compact and the yoke pivot and support rod engagement surfaces are located within the housing and therefore isolated from the hostile environment outside the housing. Unfortunately however the yoke is exposed to the conditions prevailing immediately behind the sidewall and it is not possible to lubricate the yoke given those conditions. As a result wear can still be a problem.

SUMMARY OF THE INVENTION

It is an object of the present invention to obviate or mitigate the problems outlined above.

According to the present invention, there is provided a variable geometry turbine comprising a housing, a turbine wheel mounted to rotate about a pre-determined axis within the housing, and a sidewall which is displaceable within a sidewall cavity defined by the housing to control the width of a gas flow passage extending towards the wheel between a first surface defined by the sidewall and a second surface defined by the housing, wherein the sidewall is mounted on axially displaceable rods extending parallel to the rotation axis of the wheel, a yoke is pivotally supported within the housing and defines arms each of which extends into engagement with a respective rod, and means are provided to pivot the yoke relative to the housing to control the position of the sidewall relative to the housing, the yoke being received within a yoke chamber spaced from and sealed against communication with the sidewall cavity, and means being provided to deliver lubricant to the yoke chamber.

The housing may comprise a bearing housing located between the turbine wheel housing and a compressor housing. The turbine wheel housing may receive the turbine wheel which is mounted on one end of a shaft extending through the bearing housing, and the compressor housing may receive a compressor wheel supported on the other end of the shaft. The sidewall cavity is formed in the bearing housing adjacent the turbine wheel and the yoke cavity is formed in the bearing housing adjacent the compressor wheel.

SUMMARY OF THE DRAWINGS

An embodiment of the present invention will now be described, by way of example, with reference to the accompanying drawings, in which.

DESCRIPTION OF THE INVENTION

Figure 1:
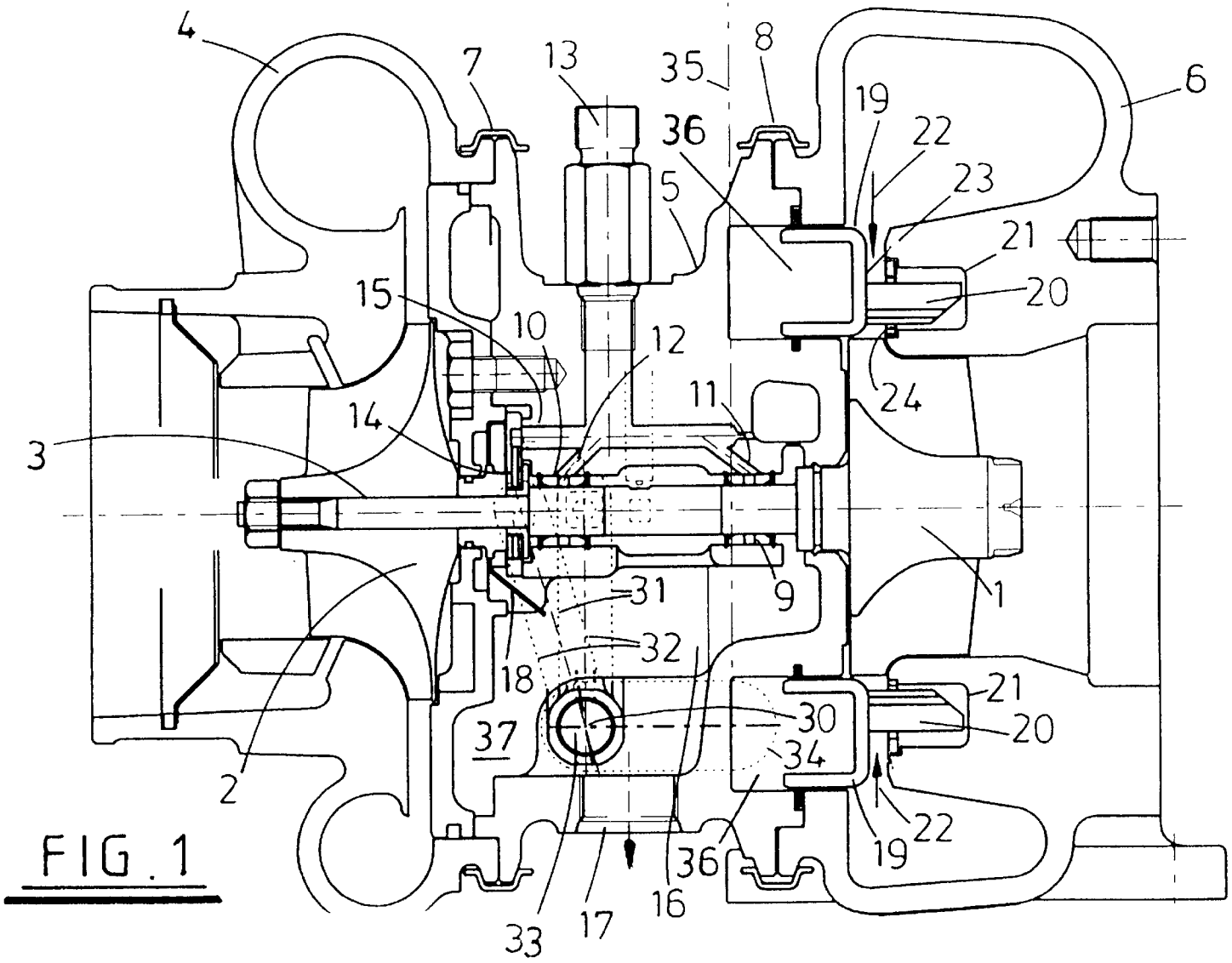
FIG. 1 is a cut-away side view of a turbocharger assembly embodying the present invention.

Referring to the accompanying drawings, a turbocharger compresses a turbine wheel 1 and compressor wheel 2 supported on a common shaft 3 within a housing defined by a compressor housing 4, a central bearing housing 5, and a turbine housing 6. The housings 4 and 5 are interconnected by an annular clip 7 and the housings 5 and 6 are interconnected by an annular clip 8. The shaft 3 is supported in bearings 9 and 10 to which lubricant is delivered via passageways 11 and 12 from suitable source via a lubricant inlet 13. Further lubricant is delivered to a bearing 14 via a passageway 15. The lubricant is collected in a chamber 16 and exists via a lubricant outlet 17. Lubricant thrown from the bearing 14 is deflected by a deflector plate 18 towards the lubricant outlet 17. Lubricant outlet 17 leads to a sump, when the turbocharger is incorporated in an internal combustion engine. The returned oil is suitably cooled through an oil cooler (not shown) so that the oil provides not only a lubricating function but a cooling function.

A displaceable sidewall 19 supports vanes 20 which project into an annular cavity 21. Exhaust gas from an internal combustion engine flows in the directions of arrows 22 through the gap defined by a first surface 23 formed by the sidewall 19 and a second surface 24 formed by the housing. The sidewall 19 is axially displaceable to control the width of the passageway defined between the surfaces 23 and 24. The sidewall 19 is shown in its fully extended position in FIG. 1 and in its fully retracted position in FIG. 2.

Figure 2:
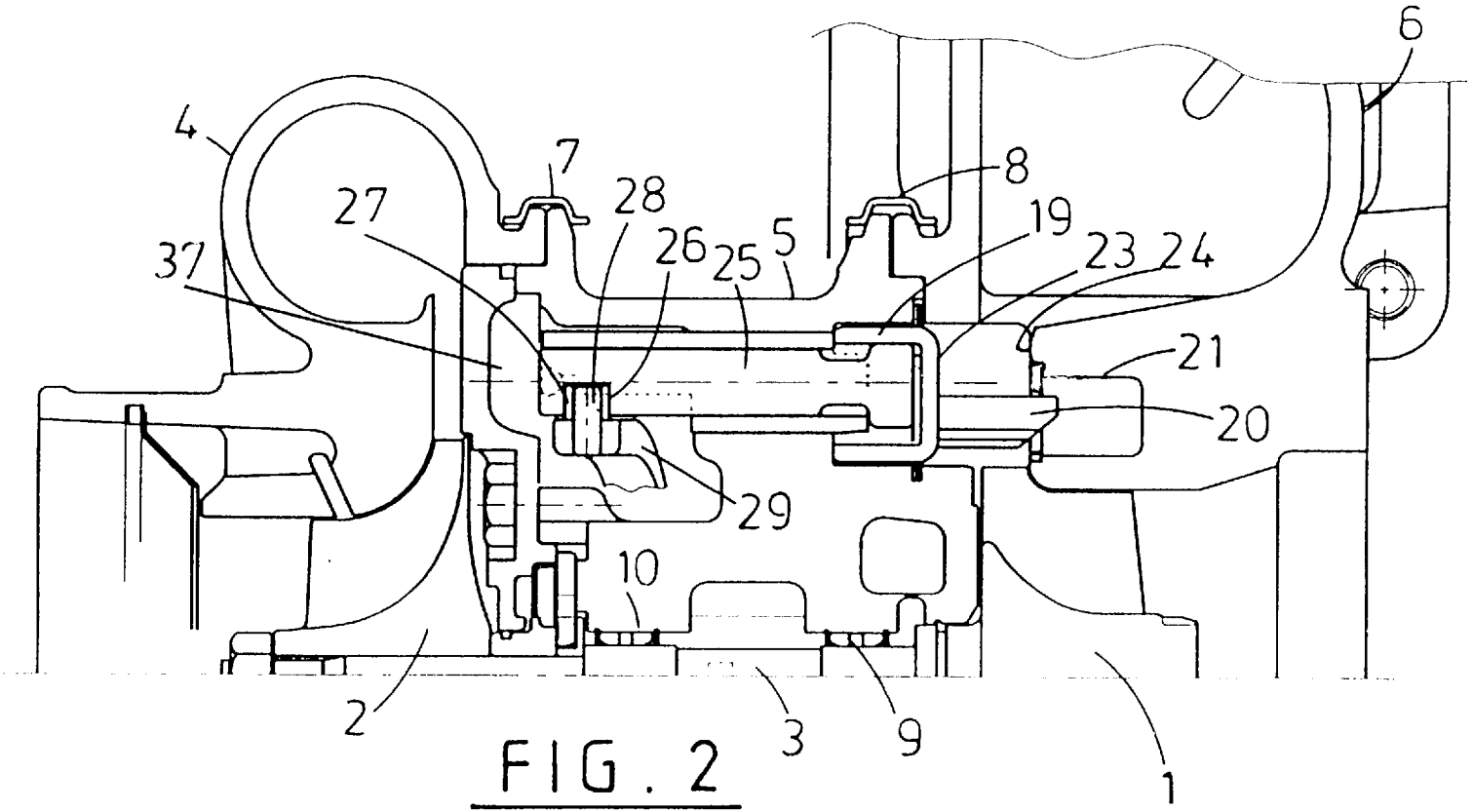
FIG. 2 is a partially cut-away view of one half of the assembly of FIG. 1 viewed from above.
Figure 3:
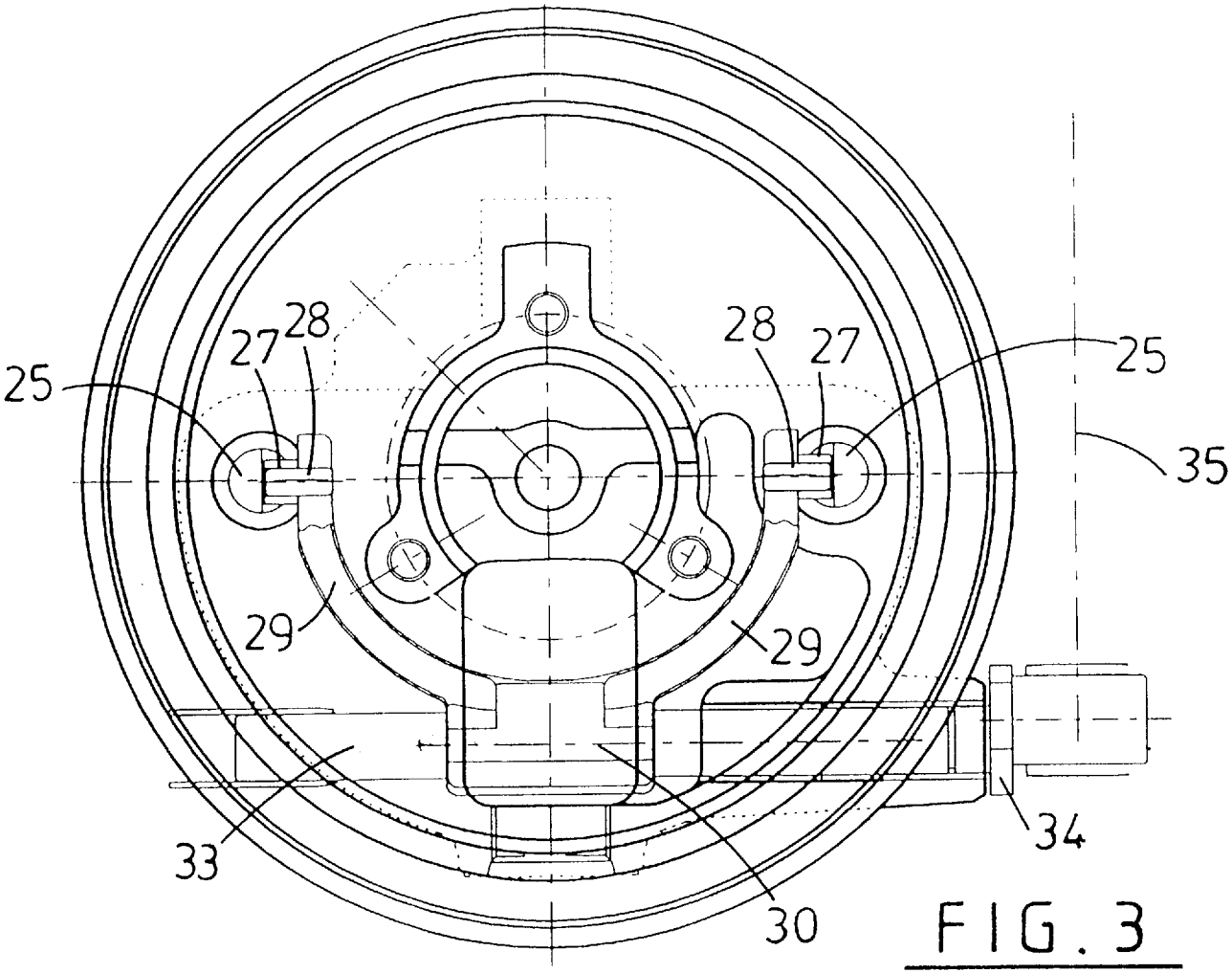
FIG. 3 is a section through the assembly of FIGS. 1 and 2 showing the relative dispositions of a sidewall control yoke and sidewall support rods engaged by the yoke.

The sidewall 19 is mounted on a pair of sidewall support rods 25 which are located on opposite sides of the shaft 3 and which slide in tubular bearings 25*a*. Each of the rods defines a slot 26 in which a block 27 pivotally mounted on a pin 28 is received, the pin in turn being mounted on an arm 29 defined by a yoke that is pivotal about an axis 30. FIG. 1 shows the yoke in two alternative positions in broken lines, the broken lines 31 representing the position of the yoke when the sidewall 19 is in the position shown in FIG. 1, and the broken lines 32 showing the position of the yoke when the sidewall 19 is in the position shown in FIG. 2. Thus it will be appreciated that rotation of the yoke about the axis 30 causes the pins 28 to describe an arc of a circle and that in turn causes the blocks 27 to move axially with and slide vertically within the slots 26 defined in the sidewall support rods 25. Axial movement of the sidewall can thus be achieved by rotation of the yoke about the axis 30.

The yoke is mounted on a shaft 33 journalled in the bearing housing 5 and supporting a crank 34. That crank 34 can be connected to any appropriate lever system as indicated by broken line 35 to enable the accurate control of the angular position of the yoke about the axis 30.

The sidewall 19 is mounted in an annular sidewall cavity 36 defined in the end of the bearing housing 5 adjacent the wheel housing 6. That cavity is exposed to high temperatures as a result of the flow of exhaust gas past sidewall 19. In the device described in U.S. Pat. No. 5,522,697, a sidewall position control yoke was located in an extension of the sidewall cavity and could not be lubricated given the conditions prevailing in the sidewall cavity. In contrast, in the illustrated arrangement the yoke is supported within a chamber 37 which is spaced from and sealed against communication with the sidewall cavity 36. Thus the interior of the chamber is not directly exposed to exhaust gases, is cooled by the cooling system (not shown in detail) provided within the bearing housing 5, and is bathed in lubricant delivered to the bearing provided to support the shaft upon which the turbine wheel is mounted. Mounting the yoke within a lubricated chamber defined by the housing enables all potential points of wear associated with movement of the yoke to be protected. Bearings provided to support a shaft carrying the turbine wheel and bearings provided to support a pivot upon which the yoke is mounted may be lubricated by a common lubrication means.

It will be appreciated that in prior art devices in which the yoke and its associated components were not lubricated the assembly had to be fabricated from expensive materials using expensive heat or surface treatments to give the necessary strength, wear resistance and corrosion resistance to achieve a long working life. High working temperatures also necessitated large working clearances between components to accommodate relative thermal expansion and distortion. Large clearances increased contact stresses between relatively moving surfaces. Finally, assembly and disassembly in service were difficult as the actuation components were inaccessible.

In contrast, with the present invention those components of the actuation assembly which slide relative to each other are located within a chamber defined by the housing in which they are splash-lubricated and cooled by the lubricant used to lubricate the turbine shaft. They are protected from engine exhaust gas, reducing corrosion problems. They can be manufactured to closer tolerances given their lubrication and cooling, and vibratory motion between interconnected components is damped out by the lubricant. Finally, the more favourable conditions to which the components are exposed makes it possible to use cheaper materials, cheaper production processes, and smaller clearances which in turn promotes better contact conditions between relatively moving surfaces. The various components are also relatively accessible to promote easier assembly and servicing.

Having described the invention, what is claimed as novel and desired to be secured by Letters Patent of the United States is:

1. A variable geometry turbine comprising a housing, a turbine wheel mounted to rotate about a pre-determined axis within the housing, and a sidewall which is displaceable within a sidewall cavity defined by the housing to control the width of a gas flow passage extending towards the wheel between a first surface defined by the sidewall and a second surface defined by the housing, wherein the sidewall is mounted on axially displaceable rods extending parallel to the rotation axis of the wheel, a yoke is pivotally supported within the housing and defines arms each of which extends into engagement with a respective rod, and means are provided to pivot the yoke relative to the housing to control the position of the sidewall relative to the housing, the yoke being received within a yoke chamber spaced from and sealed against communication with the sidewall cavity, and means being provided to deliver lubricant to the yoke chamber.

2. A variable geometry turbine according to claim 1 further comprising:

turbine wheel bearing means for journaling said turbine wheel, means for connecting said pivot means to said lubricant delivery means, whereby said bearings and pivot means are commonly lubricated.

3. A variable geometry turbine according to claim 1, wherein the housing further comprises a compressor and a shaft connecting said compressor to said turbine wheel, a compressor housing and a bearing housing located between the turbine wheel housing and said compressor housing, the turbine wheel housing receiving the turbine wheel which is mounted on one end of said shaft extending through the bearing housing, the compressor housing receiving said compressor wheel supported on the other end of the shaft, the sidewall cavity being formed in the bearing housing adjacent the turbine wheel housing, and the yoke cavity being formed in the bearing housing adjacent the compressor housing.

4. A variable geometry turbine according to claim 3 further comprising:

turbine wheel bearing means for journaling said turbine wheel, means for connecting said pivot means to said lubricant delivery means, whereby said bearings and pivot means are commonly lubricated.

* * * * *